US005891307A

United States Patent [19]

Graf

[11] Patent Number: 5,891,307

[45] Date of Patent: Apr. 6, 1999

[54] METHOD OF DETERMINING A VOLUMETRIC PERCENTAGE OF AIR IN A FIBER SUSPENSION IN A PAPER-MAKING MACHINE

[75] Inventor: Edwin X. Graf, Menasha, Wis.

[73] Assignee: Voith Sulzer Paper Technology North America, Inc., Appleton, Wis.

[21] Appl. No.: 61,300

[22] Filed: Apr. 16, 1998

[51] Int. Cl.[6] ..... D21F 11/00; G01F 5/00

[52] U.S. Cl. ..... 162/198; 162/49; 73/19.1; 73/19.01

[58] Field of Search ..... 162/198, 49, 263; 73/861.23, 861.25, 19.01, 290 V, 19.1

[56] References Cited

U.S. PATENT DOCUMENTS

| | | | |
|---|---|---|---|
| H608 | 3/1989 | Goolsby | 367/89 |
| 3,246,516 | 4/1966 | Maropis | 73/290 |
| 3,654,072 | 4/1972 | Massa | 162/49 |
| 5,621,161 | 4/1997 | Leyse | 73/19.01 |

*Primary Examiner*—Stanley S. Silverman
*Assistant Examiner*—José A. Fortuna
*Attorney, Agent, or Firm*—Taylor & Associates, P.C.

[57] ABSTRACT

In a paper-making machine, a method of determining a volumetric percentage of air in a fiber suspension for delivery to a headbox. The fiber suspension is transported through a fluid conduit. A sound transmitter and a target receiver are positioned relative to the fluid conduit. A sound is transmitted through the fiber suspension from the sound transmitter to the target receiver. A speed of the transmitted sound from the sound transmitter to the target receiver is established. The volumetric percentage of air in the fiber suspension is determined, dependent upon the established speed of sound.

9 Claims, 2 Drawing Sheets

METHOD OF DETERMINING A VOLUMETRIC PERCENTAGE OF AIR IN A FIBER SUSPENSION IN A PAPER-MAKING MACHINE

BACKGROUND OF THE INVENTION

1. Field of the Invention

The present invention relates to paper-making machines, and, more particularly, to a method of determining an amount of air in a fiber suspension in a paper-making machine.

2. Description of the Related Art

Paper-making machines typically include an approach flow system which transports a fiber suspension, such as a wood pulp suspension, to a headbox. The fiber suspension is discharged from an outlet gap of the headbox onto a forming fabric which travels at an operating speed. Water drains through the forming fabric from the fiber suspension to reduce the water content of the fiber suspension.

The presence of air within the fiber suspension causes problems during the manufacture of the paper. First, the air reduces the efficiency of the pump(s) which are used to transport the fiber suspension to the headbox. For example, a fiber suspension with approximately 5% air (by volume) may reduce the efficiency of the pump(s) by as much as 50%. This in turn means that the size of the pump must be increased and power requirements are dramatically increased. Moreover, air within the fiber suspension typically is in the form of tiny air bubbles which tend to attach via adhesion to the fibers within the fiber suspension. When the fiber suspension is discharged onto the forming fabric, these tiny bubbles do not rapidly disengage from the fibers, and interfere with the drainage of water through the forming fabric from the fiber suspension.

For the foregoing reasons, it is thus preferable to remove as much air as possible from the fiber suspension transported to the headbox. A conventional method of determining an amount of air within the fiber suspension is to draw a sample of the fiber suspension and test the fiber suspension at a location remote from the paper-making machine. This procedure is of course time consuming and labor intensive.

What is needed in the art is a method of determining an amount of air within a fiber suspension in a paper-making machine which is fast, reliable, inexpensive and provides almost instantaneous feed back.

SUMMARY OF THE INVENTION

The present invention provides a method of determining an amount (e.g., volumetric percentage) of air which is entrained within a fiber suspension in a paper-making machine by determining the speed of sound through the fiber suspension, which varies dependent upon the amount of entrained air.

The invention comprises, in one form thereof, a method of determining a volumetric percentage of air in a fiber suspension for delivery to a headbox in a paper-making machine. The fiber suspension is transported through a fluid conduit. A sound transmitter and a target receiver are positioned relative to the fluid conduit. A sound is transmitted through the fiber suspension from the sound transmitter to the target receiver. A speed of the transmitted sound from the sound transmitter to the target receiver is established. The volumetric percentage of air in the fiber suspension is determined, dependent upon the established speed of sound.

An advantage of the present invention is that the amount of air within the fiber suspension can be determined "on the fly" without affecting the flow characteristics of the flowing fiber suspension.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
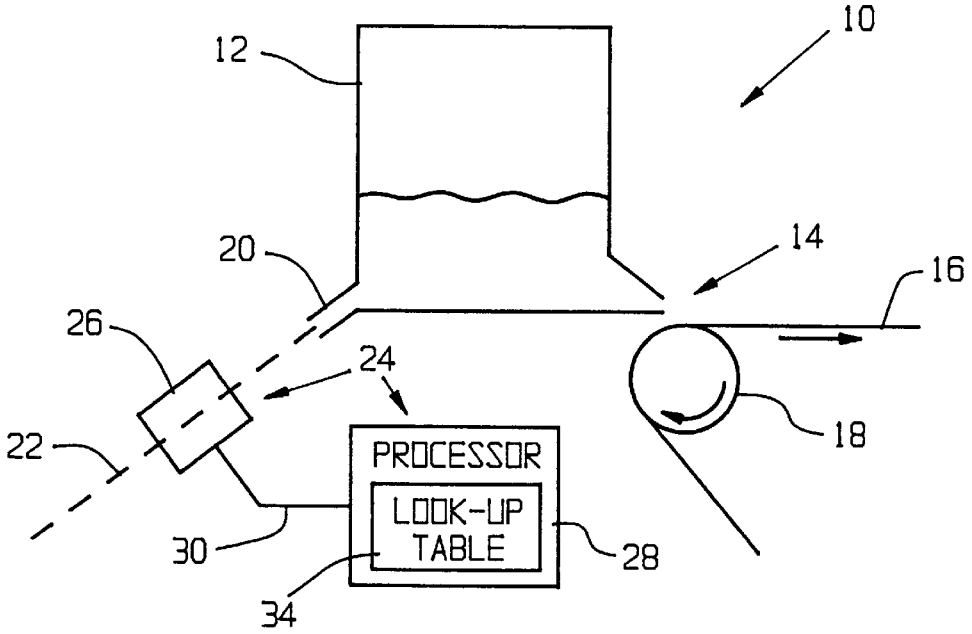
FIG. 1 is a schematic view of an embodiment of a papermaking machine which may be used to carry out the method of the present invention.

Referring now to the drawings, and more particularly to FIG. 1, there is shown a schematic illustration of an embodiment of a paper-making machine 10 for carrying out the method of the present invention. Paper-making machine 10 generally includes a headbox 12 having an outlet gap 14, from which a jet of fiber suspension with a known cross-sectional profile is jetted on to a traveling forming fabric 16 carried by a rotating breast roll 18. Headbox 12 receives the fiber suspension at an inlet 20 from a suitable fluid conduit 22, shown schematically by a dotted line.

A device 24 for determining a volumetric percentage of air in a fiber suspension transported within the fluid conduit 22 includes a sound transmitting/receiving transducer 26 which is electrically connected with an electrical processor 28 via line 30, such as a multi-conductor cable. Device 24, as will be described in more detail hereinafter, determines an amount (e.g., volumetric percentage) of air which is entrained within the fiber suspension transported through fluid conduit 22.

In general, the speed of sound is a function of the density of the material or medium through which it passes. The pressure and flow rate of the fiber suspension through fluid conduit 22 does not substantially affect the speed of sound traveling therethrough. Rather, the speed of sound is more directly related to the density of the material of fluid conduit 22, the density of the water in the fiber suspension, the density and concentration of the fibers within the fiber suspension, and the density and concentration of air within the fiber suspension.

Figure 2:
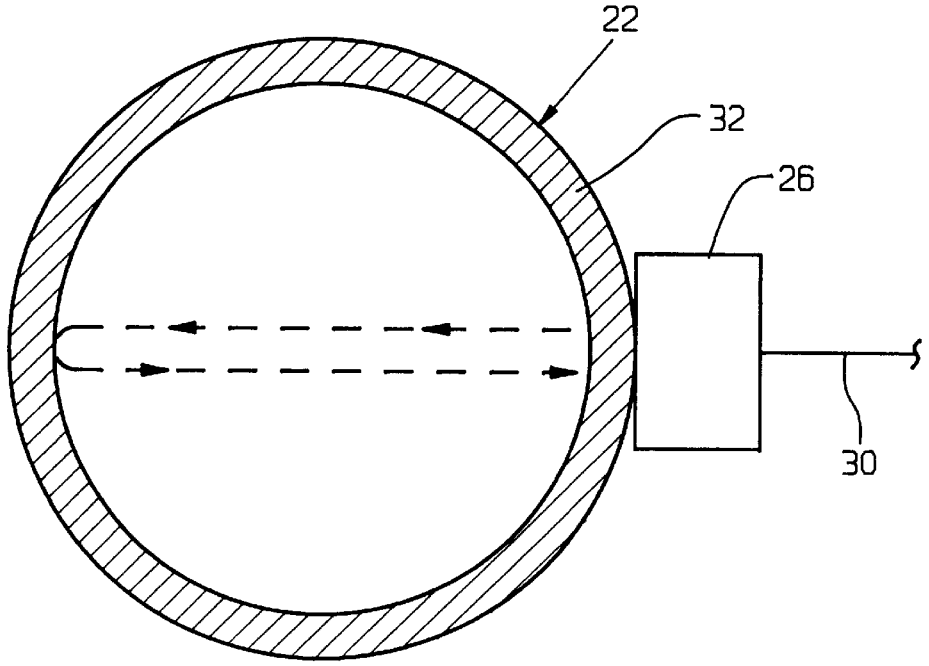
FIG. 2 is a sectional end view illustrating one embodiment of a transducer and fluid conduit used to carry out the method of the present invention.

Referring now to FIG. 2, fluid conduit 22 and transducer 26 are shown in greater detail. In the embodiment shown, fluid conduit 22 is in the form of a metal pipe having a continuous annular wall 32 which extends in the longitudinal direction of pipe 22 (transverse to the drawing of FIG. 2). Transducer 26 is mounted to an outside surface of annular wall 32 of pipe 22. Transducer 26 is a transceiving transducer, and thus includes both a sound transmitter as well as a target receiver. Transceiving transducers are known, and thus will not be described in further detail. Transducer 26 transmits a sound wave of a known frequency, intensity and duration. The sound wave passes through the immediately adjacent portion of annular wall 32 and travels through the fiber suspension within pipe 22 to a portion of the annular wall 32 disposed opposite transducer 26. At least a portion of the sound wave is then reflected back to transducer 26. Transducer 26 provides a corresponding electrical signal over line 30 to processor 28. Since the speed of sound is a function of the distance travelled (i.e., two times the distance from the transducer to the reflecting surface) divided by the time required between transmitting and receiving the sound wave, the speed of sound through an annular wall 32 and the fiber suspension with end pipe 22 may be easily established. Processor 28 also includes a look-up table 34 correlating the volumetric percentage of air in the fiber suspension, dependent upon the established speed of sound. The values in look-up table 34 are preferably empirically determined through testing. The look-up table may be, e.g., a two dimensional array with cells having values which are a function of both the speed of sound as well as the concentration of the fibers within the fiber suspension. That is, with a transducer 26 mounted to a particular pipe 22, the amount of time required to transmit and receive a selected sound wave can be empirically determined for a fiber suspension with a known fiber and air concentration. The amount of air for different fiber concentrations can be varied through testing to determine different values to be stored within the look-up table. Thus, by pairing both the fiber concentration as well as the air concentration within the fiber suspension, the values for look-up table 34 may be created prior to operation and regardless of the pressure or flow rate within pipe 22.

Of course, it will be appreciated that rather than including a look-up table which correlates the established speed of sound with a volumetric percentage of air within the fiber suspension, look-up table 34 may also directly correlate the time required between transmission and reception of the sound with the volumetric percentage of air. That is, since the speed of sound is merely a function of the geometric configuration used and the distance travelled by the sound between transmission and reception, the time value may be used directly instead of converting a value representing the speed of sound.

Figure 3:
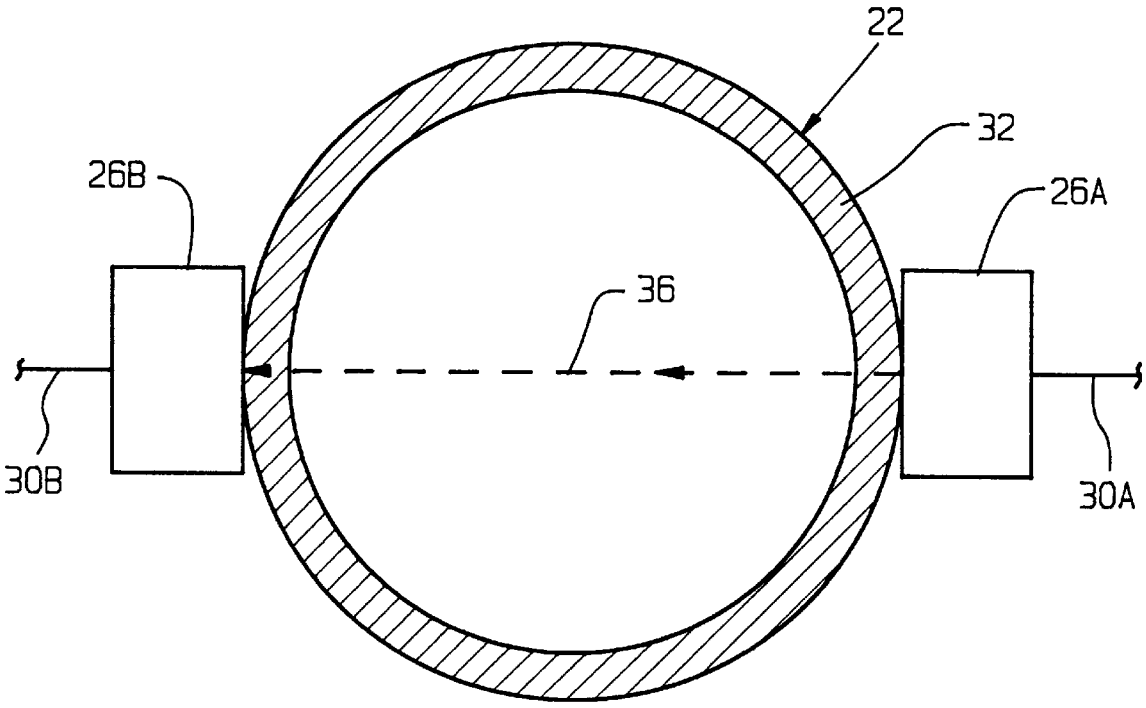
FIG. 3 is another embodiment of a fluid conduit and pair of oppositely disposed transducers used to carry out the method of the present invention.

FIG. 3 illustrates another embodiment of a device for carrying out the method of the present invention. As shown, a first transducer 26A in the form of a sound transmitter is placed on one side of pipe 22 adjacent to annular wall 32. A second transducer 26B in the form of a target receiver is positioned adjacent to annular wall 32 on a side of pipe 22 substantially opposite from first transducer 26A. A sound wave 36 of known frequency, intensity and duration is transmitted from first transducer 26A, and through opposite portions of annular wall 32 and the fiber suspension within pipe 22 to reach second transducer 26B. First transducer 26A receives an appropriate signal over line 30A to effect the sound transmission, and second transducer 26B transmits an electrical signal over line 30B back to processor 28. The configuration shown in FIG. 3. is thus in the form of a through-transmission setup with sound being transferred from first transducer 26A to second transducer 26B. This is in contrast with the configuration shown in FIG. 2 which is a reflected-transmission setup with the sound being transmitted and received by the same transducer.

In the embodiments shown in FIGS. 1–3, the sound transmitted through the fiber suspension is preferably in the form of ultrasound (e.g., above 20,000 hertz). However, it is also possible that some other type of sound, such as audible sound (below 20,000 hertz) may be used.

In the embodiment shown, fluid conduit 22 is shown in the form of a pipe in FIGS. 2 and 3. However, it is to be appreciated that the method of the present invention may be carried out by measuring the speed of sound in a fiber suspension flowing through virtually any particularly configured fluid conduit. The exact size, shape, thickness, etc., of the fluid conduit only affects the amount of time required for the sound wave to travel from the sound transmitter to the target receiver. Regardless of the particular fluid conduit utilized, empirical testing may be easily carried out to determine look-up values of the volumetric percentage of air for different fiber concentrations of the fiber suspension.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a paper-making machine, a method of determining a volumetric percentage of air in a fiber suspension for delivery to a headbox, comprising the steps of:

providing a fluid conduit;

transporting the fiber suspension through said fluid conduit;

positioning a sound transmitter relative to said fluid conduit;

positioning a target receiver relative to said fluid conduit;

transmitting a sound through the fiber suspension from said sound transmitter to said target receiver;

establishing a speed of the transmitted sound from said sound transmitter to said target receiver; and determining the volumetric percentage of air in the fiber suspension dependent upon the established speed of sound.

2. The method of claim 1, comprising the further step of measuring a time required for the sound to travel from said sound transmitter to said target receiver, said establishing step being dependent upon said measuring step.

3. The method of claim 2, providing the further steps of:

providing a look-up table correlating said measured time with the volumetric percentage of air in the fiber suspension;

looking up the volumetric percentage of air in the fiber suspension, dependent upon said measured time.

4. The method of claim 1, wherein said sound transmitter comprises a first transducer and said target receiver comprises a second transducer, said first transducer and said second transducer being respectively positioned on opposite sides of said fluid conduit.

5. The method of claim 1, wherein said sound transmitter and said target receiver are unitarily combined into a single transducer which is positioned adjacent to said fluid conduit.

6. The method of claim 1, wherein said fluid conduit comprises a pipe having at least one wall.

7. The method of claim 1, wherein said transmitting step comprises transmitting the sound through at least one said wall of said fluid conduit and the fiber suspension from said sound transmitter to said target receiver.

8. The method of claim 1, wherein said sound comprises ultrasound.

9. In a paper-making machine, a method of determining an amount of air in a fiber suspension, comprising the steps of:

transporting the fiber suspension through a fluid conduit;

positioning a sound transmitter relative to said fluid conduit;

positioning a target receiver relative to said fluid conduit;

transmitting a sound through the fiber suspension from said sound transmitter to said target receiver;

establishing a speed of the transmitted sound from said sound transmitter to said target receiver; and determining an amount of air in the fiber suspension dependent upon the established speed of sound.

* * * * *